United States Patent [19]

Nightingale et al.

[11] 3,950,232

[45] Apr. 13, 1976

[54] PROCESS FOR REMOVING ELECTRODEPOSITS

[75] Inventors: Colin Walter Nightingale, Liverpool; Georg Paul Richard Bielstein, London; David Alexander Taylor, Kenton-Middlesex; William Nelson, Birkenhead, all of England

[73] Assignee: British Copper Refiners Limited, London, England

[22] Filed: Feb. 4, 1974

[21] Appl. No.: 439,025

[52] U.S. Cl. ..... 204/12; 204/198

[51] Int. Cl. ..... C25d 1/04

[58] Field of Search ..... 204/108, 112, 119, 198, 204/12, 105 R

[56] References Cited

UNITED STATES PATENTS

| | | | |
|---|---|---|---|
| 1,525,075 | 2/1925 | Hill | 204/12 |
| 3,625,806 | 12/1971 | Wennberg | 204/12 |
| 3,689,396 | 9/1972 | Casagrande et al. | 204/198 |

OTHER PUBLICATIONS

"Electrochemistry" by M. K. Thompson, 1925, pp. 234–235.

*Primary Examiner*—R. L. Andrews

*Attorney, Agent, or Firm*—Buell, Blenko & Ziesenheim

[57] ABSTRACT

Metal, e.g., copper, is electrolytically refined by a series process in which the intermediate electrodes are removed from the tank of electrolyte solution before all the impure metal has been dissolved from them, and each partially refined intermediate electrode so formed is passed in turn through apparatus which mechanically separates the pure and impure metal of the electrode. Preferably the electrode-separating apparatus distorts the pure and impure metal of the electrode to such an extent that they are separated. The separated pure and impure metals of each electrode are preferably conveyed from the electrode-separating apparatus along separate predetermined paths. All these operations are preferably effected automatically.

11 Claims, 6 Drawing Figures

PROCESS FOR REMOVING ELECTRODEPOSITS

This invention relates to the method of refining metal in which plates of the metal to be refined form electrodes, hereinafter referred to as unrefined electrodes, in an electrolytic cell containing an electrolyte.

The invention is particularly concerned with the series process of electrolytically refining metal in which a plurality of unrefined electrodes are supported in the electrolyte, all of a group of said electrodes except the first and last are bi-polar (such bi-polar unrefined electrodes being hereinafter, for convenience, referred to as intermediate electrodes) and a direct current enters the group at the first electrode or anode at the positive end of the group, generally travels from each intermediate electrode through the electrolyte to the next in line and so forth until it leaves the group at the last electrode or cathode at the negative end of the group. In this way impure metal is dissolved from one side of each intermediate electrode and pure metal is deposited on the other side of the electrode. Because metal is not dissolved from one side of the last electrode or cathode, this electrode, generally called the starting cathode, is customarily of pure metal and initially thinner than the intermediate electrodes.

Although unidirectional direct current is normally used in the series process the term series process as used herein is not intended to exclude series processes in which the current is reversed or interrupted for short periods.

The invention is especially, but not exclusively, concerned with electrolytic refining of copper by the series process in which the unrefined electrodes are immersed in an electrolytic cell, usually containing an aqueous solution of copper sulphate and acidified with sulphuric acid. Other metals that may be refined by the series process include nickel and zinc.

In one form of the series refining process it is necessary to separate the deposited pure metal and the residual impure metal of each partially refined intermediate electrode and it has been the practice in the series process of refining copper to effect this operation manually by driving a wedge into the plane of weakness between the pure and impure metal but this method is both tedious and time consuming and is costly. The time and effort incurred in separating the pure and impure metal of a partially refined electrode can be reduced to some extent by coating that surface of the intermediate electrode on which the pure metal is to be deposited with a release agent that reduces the strength of the bond between the pure and impure metal and facilitates separation, but the time and manual effort required to separate each of a cell load of partially refined intermediate electrodes are undesirable from the economic point of view. With intermediate electrodes of large superficial area and large weight even when a release agent is employed manual separation of each partially refined intermediate electrode is even more time consuming and even less economic.

The present invention has for its principal object the provision of an improved method of electrolytically refining metal by the series process in which the time and manual effort in separating the partially refined intermediate electrodes are substantially reduced and hence the economic efficiency of the overall refining process is substantially increased.

According to the invention the method comprises immersing unrefined electrodes in an electrolyte solution contained in a tank, passing a direct current through the electrolyte to cause impure metal from one of the electrodes to be dissolved in the electrolyte solution and deposited as pure metal on another of the electrodes, removing the electrodes from the tank before all the impure metal has been dissolved therefrom, and passing each partially refined intermediate electrode so formed in turn through apparatus which mechanically separates the pure and impure metal of the electrode.

Preferably the separated pure metal of each electrode constituting the refined product of the process is conveyed from the electrode-separating apparatus along a predetermined path to a storage area or further processing apparatus and the impure metal of each electrode is conveyed from the apparatus along a second predetermined path for re-melting in due course. Preferably also partially refined intermediate electrodes which the apparatus has failed to separate or which are otherwise unsatisfactory are automatically and/or selectively rejected by the apparatus and conveyed along a third predetermined path for manual separation, or along the second predetermined path for re-melting. Pure metal travelling along the first predetermined path may be caused to pass through or past apparatus which detects, and measures the quantity of, any impure metal still carried by the pure metal, pure metal carrying an unacceptable quantity of impure metal being then caused to travel along a path different from that along which pure metal travels.

After the partially refined intermediate electrodes have been removed from the tank preferably the intermediate electrodes are passed in turn through apparatus which washes any electrolyte solution or other foreign matter carried by a partially refined electrode from the electrode before it is passed through the apparatus which mechanically separates the pure and impure metal of the electrode.

The operations of removing the electrode from the tank, passing each electrode in turn to the electrode washing apparatus when present, passing each electrode in turn to the electrode separating apparatus, mechanically separating the partially refined intermediate electrodes and passing the pure and impure metals along predetermined paths may be effected automatically or semi-automatically.

Since neither the pure nor the impure metal of any electrode is required for re-use as an intermediate electrode in a series refining process without being remelted and processed, mechanical separation of the pure and impure metal of a partially refined electrode can be effected without regard to any distortion that may be imparted to either the pure or the impure metal and consequently mechanical separation is preferably effected by splitting the electrode along the plane of weakness between the pure and impure metal, or by distortion of the electrode to such an extent that the pure and impure metals separate, or by a combination of these two methods.

To facilitate start of the separation of the pure and impure metal of a partially refined intermediate electrode when at least part of the mechanical separation operation is to be effected by distortion of the electrode, the unrefined intermediate electrodes are preferably so supported in the tank that a portion of each electrode adjacent the upper edge protrudes above the surface of the electrolyte. In this way when the partially refined intermediate electrodes are removed from the tank, each electrode has adjacent its upper boundary edge an unrefined boundary portion on which substantially no pure metal has been deposited. Distortion of a partially refined intermediate electrode having adjacent one of its boundary edges an unrefined boundary portion may be caused, for instance, by folding or rolling the electrode about a convexly curved surface, but preferably initial distortion of a partially refined intermediate electrode and subsequent separation of the pure and impure metal of the electrode is effected by the method and by means of the apparatus forming the subject of British patent application No. 31030/73 of British Insulated Callender's Cables Limited, filed on June 29, 1973.

In the method of the aforesaid British patent application, a partially refined electrode is supported with its unrefined boundary portion gripped by clamping means; limited relative movement is effected between said clamping means and the partially refined portion of the electrode such that said unrefined boundary portion is moved from the plane of said partially refined portion of the electrode into a plane intersecting or meeting said first mentioned plane in a line on or parallel to the boundary between the partially refined portion and unrefined boundary portion, in such a direction that the impure metal will tend to peel from the pure metal adjacent said unrefined boundary portion along the plane of weakness between the pure and impure metal; a separating device is introduced into the split so formed between the pure and impure metal; and relative movement is effected between the separating device and the electrode in such a direction and to such an extent as to cause the pure and impure metals of the electrode to separate.

The limited relative movement between the clamping means and the partially refined portion of the electrode is preferably effected by causing the clamping means to pivot about an axis spaced from and substantially parallel to the boundary between the partially refined and unrefined boundary portions of the electrode in such direction that the impure metal will tend to peel from the pure metal and, at the same time, by limiting the extent of the resultant pivotal movement of the partially refined portion of the electrode.

Preferably the unrefined electrode is suspended from the clamping means substantially vertically and the clamping means is caused to pivot about a substantially horizontal axis positioned above the suspended electrode and passing through the clamping means. This pivotal axis preferably lies in a substantially vertical plane substantially coplanar with the plane of weakness of the suspended electrode.

After pivotal or other movement of the clamping means has been effected to a sufficient extent to cause the initial split in the plane of weakness between the pure and impure metal, preferably the lowermost edge of the suspended electrode is temporarily supported and the initial split is positioned beneath the separating device which is moved vertically downwards to separate the pure and impure metal.

Alternatively, distortion of a partially refined intermediate electrode may be caused by percussion, vibration or by feeding the electrode between two or more rolls.

Where the pure and impure metal of a partially refined intermediate electrode is mechanically stripped apart, for instance, by causing a blade or other stripping device to be urged between the pure and impure metals along the plane of weakness, start of the splitting action may be facilitated by initially arranging a wedge-shaped elongate member of an electrically conducting material to be immersed in the electrolyte and to extend immediately adjacent one edge of that surface of the unrefined electrode on which pure metal is to be deposited. The wedge-shaped member serves both to prevent pure metal from bonding to the impure metal along that edge and, when subsequently removed, to provide a start for insertion of the splitting blade or other device along the plane of weakness. The wedge-shaped member is preferably arranged to extend immediately adjacent the electrode along its upper edge and is preferably secured to or integral with means supporting the electrode in the tank so that when said supporting means is disengaged from the partially refined electrode, the wedge-shaped member is also removed.

In all cases before the intermediate electrodes are immersed in the tank, preferably that surface of each electrode on which pure metal is to be deposited, and the wedge-shaped elongate member when present, is coated with a release agent to facilitate separation of the pure and impure metals. Pure metal emerging from the mechanical separating apparatus may be subjected to a washing or other suitable process by means of which residue release agent on the pure metal is substantially removed. Preferably also the refining process is effected until 5 to 50% of the impure metal remains on each partially refined electrode.

The invention also includes apparatus for carrying out the method of the invention as hereinbefore described.

The method and apparatus of the present invention are especially, but not exclusively, suitable for use in the method of electrolytically refining copper described and claimed in the complete specification of our Pat. No. 1067297.

The invention will be further illustrated by a description, by way of example, of a preferred method of and apparatus for electrolytically refining copper by the series process with reference to the accompanying drawings, in which.

Figure 1:
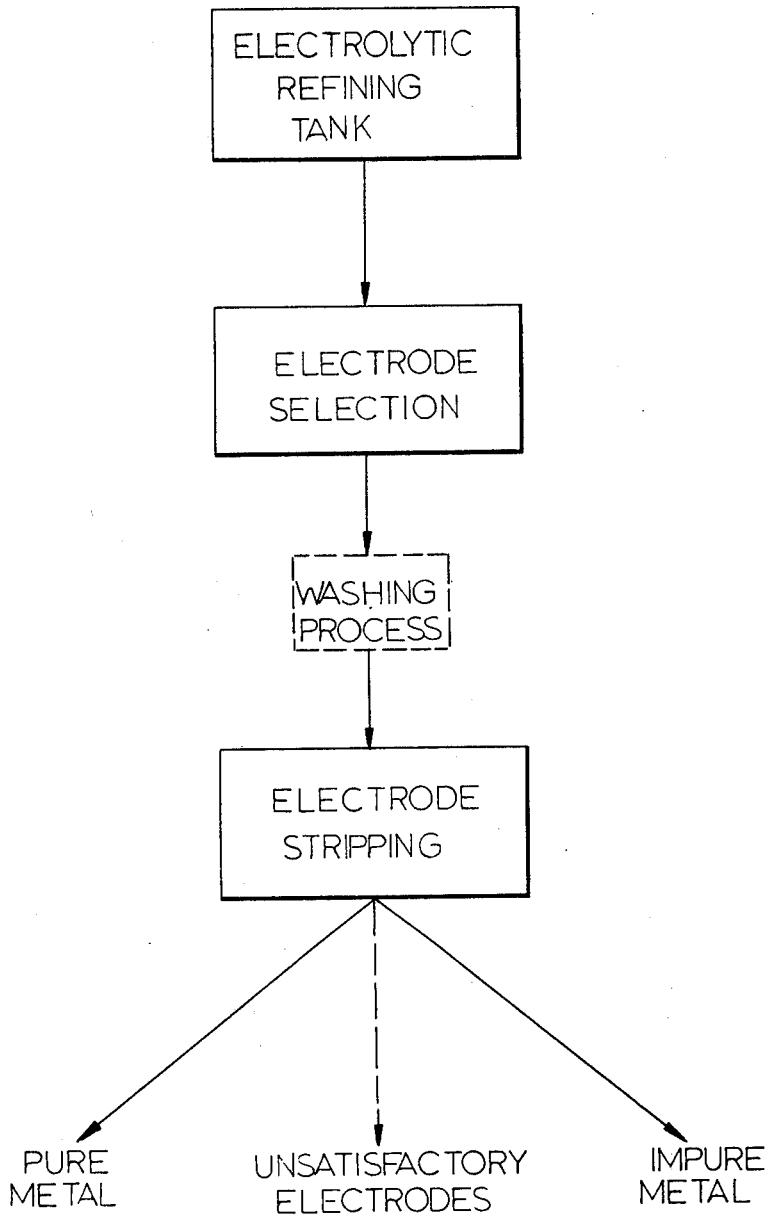
FIG. 1 is a block diagram illustrating the sequence of operations in the method.
Figure 2:
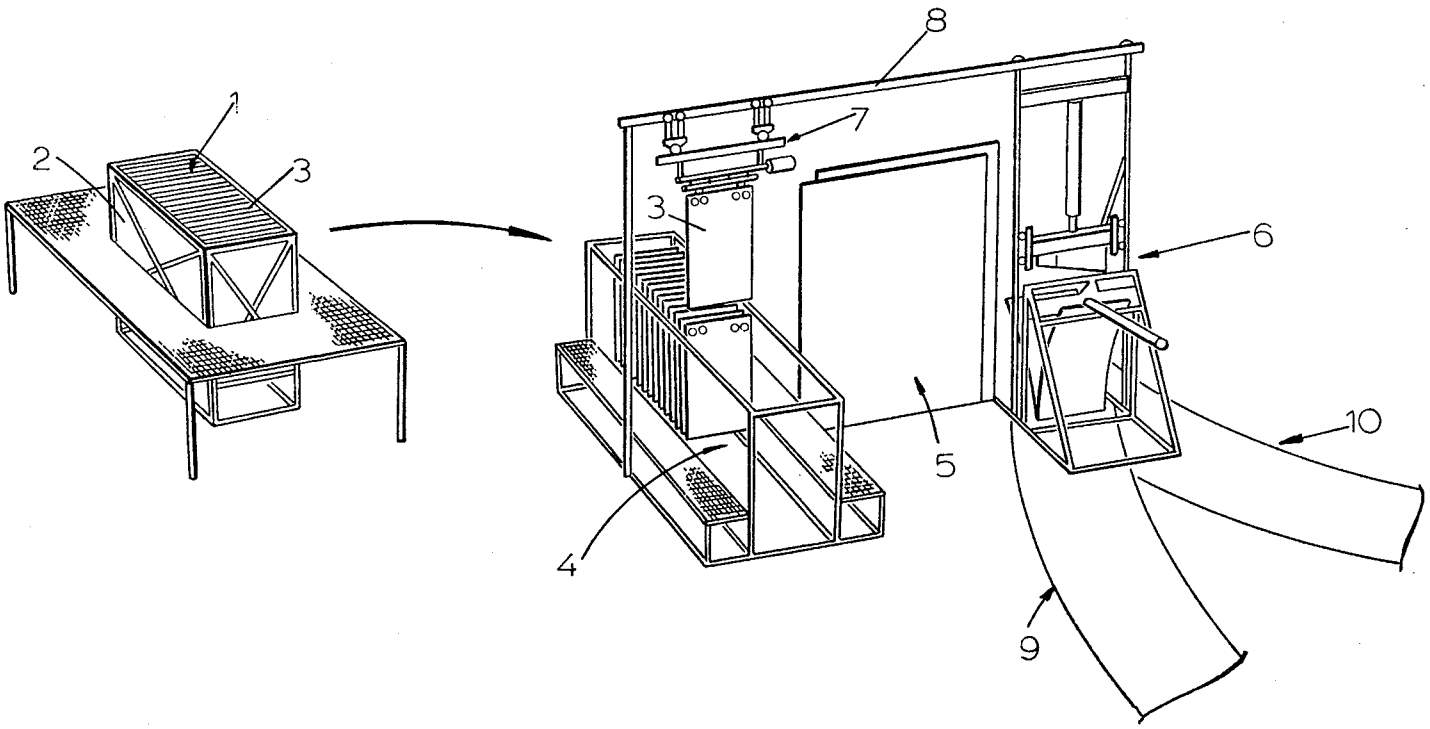
FIG. 2 is a diagrammatic perspective view of the apparatus employed in the method illustrated in FIG. 1, and FIG. 3 (*a* to *d*) illustrates diagrammatically the preferred method of mechanically separating the pure and impure metal of a partially refined intermediate electrode.

In the method of and apparatus for electrolytically refining copper diagrammatically illustrated in FIGS. 1 and 2 a plurality 1 of unrefined electrodes are immersed in an electrolyte solution contained in a tank 2 in such a way that a portion of each electrode 3 adjacent the upper edge protrudes above the surface of the electrolyte solution. A direct current is passed through the electrolyte solution, entering the group of unrefined electrodes at the anode at the positive end of the group, generally travelling from each intermediate electrode through the electrolyte solution to the next in line and so forth until the direct current leaves the group at the cathode at the negative end of the group. Impure copper is dissolved from one side of each intermediate electrode and pure copper is deposited on the other side of the intermediate electrode. Substantially no impure copper is dissolved from or deposited on the portion of each intermediate electrode that protrudes above the surface of the electrolyte solution, thereby leaving each partially refined intermediate electrode with an unrefined boundary portion. The refining process is continued in this way until approximately 30% of the impure copper remains on each partially refined intermediate electrode.

At this juncture the direct current is switched off and the plurality of electrodes are removed from the tank in a group and are suspended in the same group in a storage area 4. When it is required to separate the pure and impure metals of the partially refined intermediate electrodes the group of electrodes are caused to pass in turn through a washing apparatus 5 to a mechanical stripping apparatus 6. In this operation each partially refined intermediate electrode in turn is lifted from the group of electrodes by an overhead support device 7 suspended from a gantry 8 and the support device is caused to travel along the gantry to carry the intermediate electrodes into, and to cause it to travel through, the washing apparatus 5 where residual electrolyte solution is washed from the intermediate electrodes.

After the electrode has emerged from the washing apparatus 5 the support device is caused to travel further along the gantry 8 to carry the washed intermediate electrode to the mechanical stripping apparatus 6. At the mechanical stripping apparatus 6 the pure and impure metals of the electrode are separated, the pure metal dropping into a chute 9 which directs it to a conveyor which carries the pure metal along a predetermined path to a storage area and the impure metal dropping into a chute 10 which directs it to a conveyor which carries the impure metal along a second predetermined path to a storage area prior to re-melting.

Any partially refined intermediate electrodes whose pure and impure metals cannot be separated or is otherwise unsatisfactory is also caused to drop into the chute 10 so that it can be conveyed for re-melting.

The operations of removing the intermediate electrodes in turn from the storage area 4, causing each electrode to be carried in turn through the washing apparatus 5 to the mechanical stripping apparatus 6, mechanically separating the pure and impure metals of each electrode and conveying the pure and impure metals along predetermined paths may be effected semiautomatically or automatically.

Figures 3A, 3B, 3C, 3D:
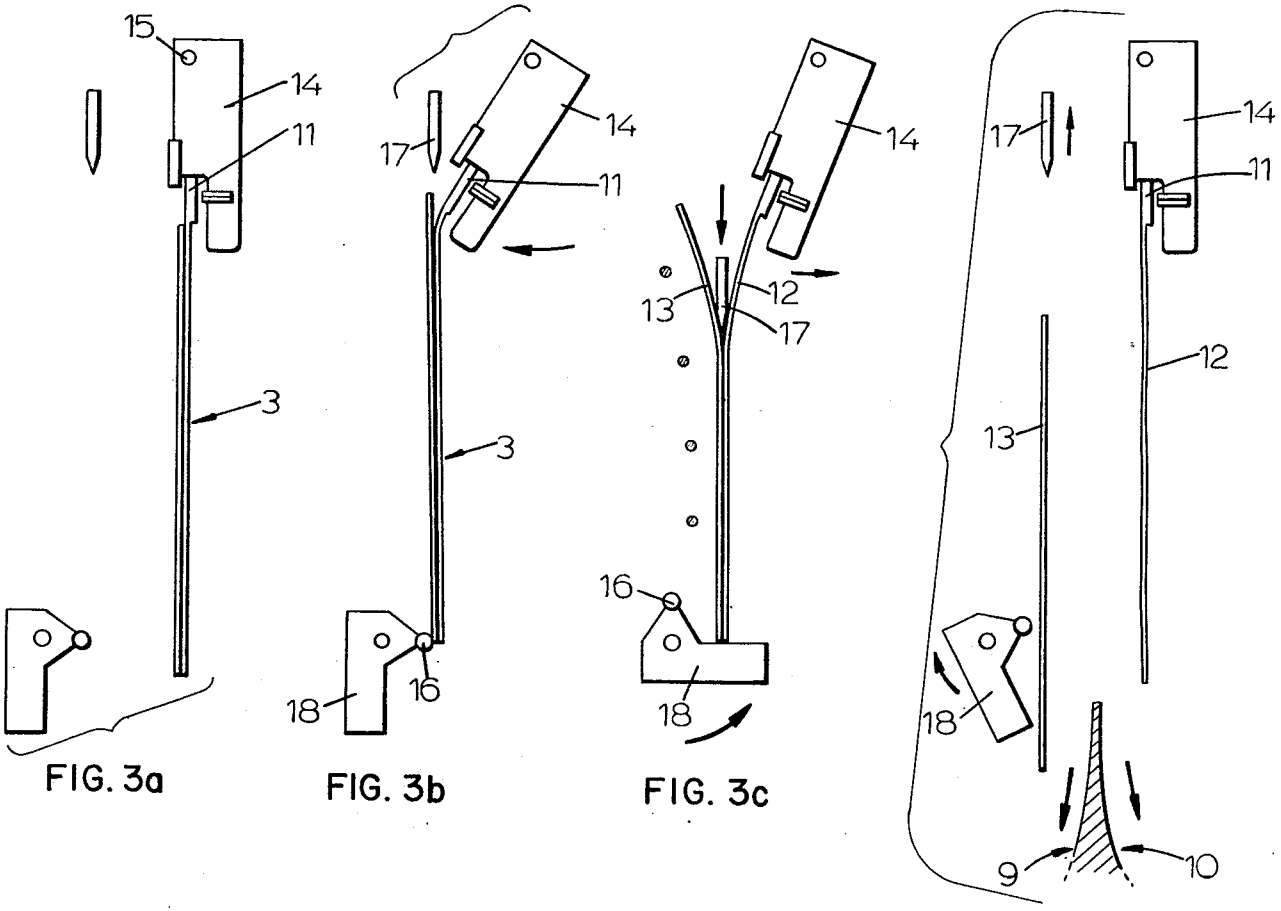

In the preferred method of mechanically separating the pure and impure metal of a partially refined intermediate electrode as illustrated diagrammatically in FIG. 3, the unrefined boundary portion 11 of an electrode 3 is gripped in the jaws of a clamping device 14 (FIG. 3(*a*)) which is pivotally mounted about a substantially horizontal axis 15 so that the electrode is suspended substantially vertically. The clamping device 14 is caused to pivot about its axis 15 in a clockwise direction but similar pivotal movement of the suspended electrode is prevented by a stop 16 which is engaged by a lower part of the electrode. As a result the impure copper 12 of the electrode tends to pull away from the pure copper 13 (FIG. 3(*b*)). The stop 16 arrests movement of the electrode 3 when it is suspended below a separating blade 17 and, at the same time, when the lower part of the electrode engages the stop a temporary support 18 is adapted to pivot about a horizontal axis and engage the lowermost edge of the electrode. The separating blade 17 now moves vertically downwards in a plane co-planar with the plane of weakness of the suspended electrode 3 (FIG. 3(*c*)) to separate the impure copper 12 and pure copper 13, the pure copper 13 falling from the electrode and being directed by the chute 9 to a conveyor for carrying it to a storage area and, on release of the jaws of the clamping device 14, the impure copper 14 falling into the chute 10 from where it is directed to a conveyor for carrying it to another storage area prior to re-melting. After separation of the pure and impure copper has been effected the blade 17, the temporary support 18 and the clamping device 14 return to their original positions ready to receive the next electrode.

The operations of clamping an electrode in the jaws of the clamping device 14, causing the clamping device to pivot about a horizontal axis 15, causing the temporary support 18 to pivot about a horizontal axis, lowering of the separating blade 17, releasing the jaws of the clamping device and returning the clamping device, temporary support and separating blade to their original positions may be effected automatically or semiautomatically, preferably in conjunction with the operations of removing an electrode from the storage area 4 and passing it through the washing apparatus 5 to the mechanical stripping apparatus.

One important advantage provided by the present invention is that only a single separating operation is required for each partially refined intermediate electrode and this is effected mechanically by apparatus which may require only the supervision of a machine operator. Since no part of the partially refined electrode is used again as an electrode without being remelted and processed, no special precautions are necessary to ensure that that part of the electrode on which pure metal is deposited suffers no damage during the mechanical separating operation.

What we claim as our invention is:

1. A method of electrolytically refining metal by the series process which comprises immersing unrefined electrodes in an electrolyte solution contained in a tank; passing a direct current through the electrolyte to cause impure metal from one of the electrodes to be dissolved in the electrolyte solution and deposited as pure metal on another of the electrodes, to form partially refined intermediate electrodes each having adjacent one of its boundary edges an unrefined boundary portion; removing the electrodes from the tank before all the impure metal has been dissolved therefrom; passing each electrode so formed in turn through apparatus in which the electrode is supported with its unrefined boundary portion gripped by clamping means; effecting limited relative movement between said clamping means and the partially refined portion of the electrode so that said unrefined boundary portion is moved from the plane of said partially refined portion of the electrode into a plane intersecting said first mentioned plane in a line substantially parallel to the boundary between the partially refined portion and unrefined boundary portion, in such a direction that impure metal adjoining said unrefined boundary portion peels from pure metal adjacent said unrefined boundary portion to form a split along the plane of weakness between the pure and impure metal; introducing a separating device into the split so formed between the pure and impure metal; and moving the separating device relative to the electrode in such a direction and to such an extent as to cause complete separation of the pure and impure metals of the electrode.

2. A method as claimed in claim 1, wherein the separated pure metal of each electrode is conveyed from the electrode-separating apparatus along a predetermined path and the impure metal of each electrode is conveyed from the electrode-separating apparatus along a second predetermined path.

3. A method as claimed in claim 2 wherein any partially refined intermediate electrode which the electrode-separating apparatus has failed to separate is automatically rejected by the apparatus and conveyed along a third predetermined path for manual separation, or along the second predetermined path for remelting.

4. A method as claimed in claim 2 wherein pure metal travelling along the first predetermined path is caused to pass through apparatus which detects, amd measures the quantity of, any impure metal still carried by the pure metal, pure metal carrying an unacceptable quantity of impure metal being then caused to travel along a path different from that along which pure metal travels.

5. A method as claimed in claim 2 wherein the operations of removing the electrodes from the tank, passing each electrode in turn to the electrode-separating apparatus, mechanically separating the partially refined electrodes and passing the pure and impure metals along predetermined paths are effected automatically.

6. A method as claimed in claim 1 wherein after the partially refined intermediate electrodes have been removed from the tank, the intermediate electrodes are passed in turn through apparatus which washes any electrolyte solution carried by a partially refined electrode from the electrode before it is passed through the electrode-separating apparatus.

7. A method as claimed in claim 1 wherein before the intermediate electrodes are immersed in the tank that surface of each electrode on which pure metal is to be deposited is coated with a release agent to facilitate separation of the pure and impure metals.

8. A method as claimed in claim 1 wherein the metal which is electrolytically refined is copper.

9. A method of electrolytically refining metal by the series process which comprises immersing unrefined electrodes in an electrolyte solution contained in a tank; passing a direct current through the electrolyte to cause impure metal from one of the electrodes to be dissolved in the electrolyte solution and deposited as pure metal on another of the electrodes, to form partially refined intermediate electrodes each having adjacent one of its boundary edges an unrefined boundary portion; removing the electrodes from the tank before all the impure metal has been dissolved therefrom; passing each electrode so formed in turn through apparatus in which the electrode is supported with its unrefined boundary portion gripped by clamping means; causing the clamping means to pivot to a limited extent about an axis spaced from and substantially parallel to the boundary between the partially refined and unrefined boundary portions of the electrode in such a direction that impure metal adjoining said unrefined boundary portion peels from pure metal adjacent said unrefined boundary portion to form a split along the plane of weakness between the pure and impure metal; introducing a separating device into the split so formed between the pure and impure metal; and moving the separating device relative to the electrode in such a direction and to such an extent as to cause complete separation of the pure and impure metals of the electrode.

10. A method as claimed in claim 9 wherein the unrefined electrode in the electrode-separating apparatus is suspended from the clamping means substantially vertically and the clamping means is caused to pivot about a substantially horizontal axis positioned above the suspended electrode and passing through the clamping means.

11. A method as claimed in claim 10 wherein after pivotal movement of the clamping means has been effected to a sufficient extent to cause the initial split in the plane of weakness between the pure and impure metal, the lowermost edge of the suspended electrode is temporarily supported and the initial split is positioned beneath the separating device which is moved vertically downwards to separate the pure and impure metal.

* * * * *